US007152516B2

(12) United States Patent
Huang

(10) Patent No.: US 7,152,516 B2
(45) Date of Patent: Dec. 26, 2006

(54) MULTI-STAGE MOVEMENT PAPER PUNCH

(76) Inventor: Chien Kai Huang, No.136, Tsu Chiang Road, Chang Hua City (TW)

( * ) Notice: Subject to any disclaimer, the term of this patent is extended or adjusted under 35 U.S.C. 154(b) by 193 days.

(21) Appl. No.: 11/003,412

(22) Filed: Dec. 6, 2004

(65) Prior Publication Data

US 2006/0117927 A1 Jun. 8, 2006

(51) Int. Cl.
*B26D 5/08* (2006.01)

(52) U.S. Cl. ..... 83/620; 83/627; 83/629

(58) Field of Classification Search ..... 83/627–636, 83/613, 618, 620, 603, 554, 563, 564
See application file for complete search history.

(56) References Cited

U.S. PATENT DOCUMENTS 1,124,893 A * 1/1915 Gustafson ..... 83/554
2,127,260 A * 8/1938 Kaiser ..... 408/99
3,714,857 A * 2/1973 Stuertz et al. ..... 83/633
3,826,168 A * 7/1974 Groswith et al. ..... 83/629
5,178,049 A * 1/1993 Tsai-Hsin ..... 83/620
5,664,473 A * 9/1997 Huang ..... 83/620
6,540,451 B1 * 4/2003 Mori ..... 83/629

* cited by examiner

*Primary Examiner*—Stephen Choi
(74) *Attorney, Agent, or Firm*—Bacon & Thomas, PLLC

(57) ABSTRACT

A paper punch includes a ratchet assembly received in each of the frames on a base. A handle assembly is connected to the frames. The ratchet assembly includes ratchet wheels co-rotatably connected to the driving gear which drives a rack to lower the punch head. The handle assembly includes a driving pawl which is engaged with two teeth in sequence of the ratchet wheels to proceed the punching action, and a return pawl which rotates the ratchet wheels in opposite direction after the punching action is finished. The handle assembly is repeatedly operated while the punch head is kept in the pile of paper sheets to be punched. The angular movement of each movement of the handle assembly is less than 90 degrees.

8 Claims, 10 Drawing Sheets

MULTI-STAGE MOVEMENT PAPER PUNCH

FIELD OF THE INVENTION

The present invention relates to a paper punch wherein the handle can be pivoted upward to start position while the punch head is stayed in the middle of a thick pile of paper sheets.

BACKGROUND OF THE INVENTION

A conventional paper punch, especially a paper punch that is used for punching holes through a thick pile of paper sheets is disclosed in FIGS. 1 and 2, and generally includes a base 1 with a plurality of frames 2 extending from a top of the base 1, a handle 3 pivotably connected to the frames 2, a driving gear 4 co-rotatably connected to the handle 3, a punch head 5 connected to a top portion 7 and a rack 6 is fixed to the top portion 7 and engaged with the driving gear 4. When punching a thick pile of paper sheets 8 on the base 1, the user simply pivots the handle 3 downward and the driving gear 4 drives the rack 6 together with the top portion 7 downward, the punch head 5 penetrates through the pile of paper sheets 8. Although the mechanism composed of the driving gear 4 and the rack 6 provides a sufficient force to punch the paper sheets 8, the resistance from the paper sheets 8 is huge during the punching. It is noted that the travel of the pivotal movement of the handle 3 is over 90 degrees and this long travel makes the user change his or her arms to apply a continuous force to the handle 3. This change of arms could hurt the wrist. Some manufacturers increase the height of the frames 2 to increase the travel of the handle 3 to allow the angular travel of the handle 3 less than 90 degrees, this change increases the manufacturing cost and loses commercial benefits.

The present invention intends to provide a paper punch wherein the handle can be pivoted upward to the initial position while the punch head is stay in the paper sheets so that the angular travel of the handle is kept in a range that is less than 90 degrees.

SUMMARY OF THE INVENTION

The present invention relates to a paper punch that comprises a base with a plurality of frames extending from a top of the base and each frame includes a hollow column which is fixed on the base and each frame has a driving gear received therein. A moving member connected to a punching head is movably located in front of each of the frames and driven by the driving gear in each of the frames. A handle assembly is co-rotatably connected to the driving gears in the frames and includes a plurality of handles. Each handle has two end caps connected on two sides thereof.

A ratchet assembly is received in each of the frames and has two ratchet wheels which are connected to the driving gear by positioning pins, two driving pawls and two return pawls. Each of the end caps has one of the two driving pawls and one of the return pawls received therein. Each of the ratchet wheels is located between the driving pawl and the return pawl in each end cap. Each of the ratchet wheels has a first tooth, a second tooth and a return tooth. The first and second teeth have two respective inclined surfaces of the same inclination and the return tooth has an inclined surface that is opposite to the two inclined surfaces of the first and second teeth. The driving pawls are engaged with the first teeth and the second teeth in sequence to rotate the ratchet wheels and the driving gear in two times of downward pivotal movement of the handles. The return teeth is engaged with the return pawl of the ratchet wheels and rotates the ratchet wheels and the driving gear by pivoting the handles upward after the two times of downward pivotal movement of the handles.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
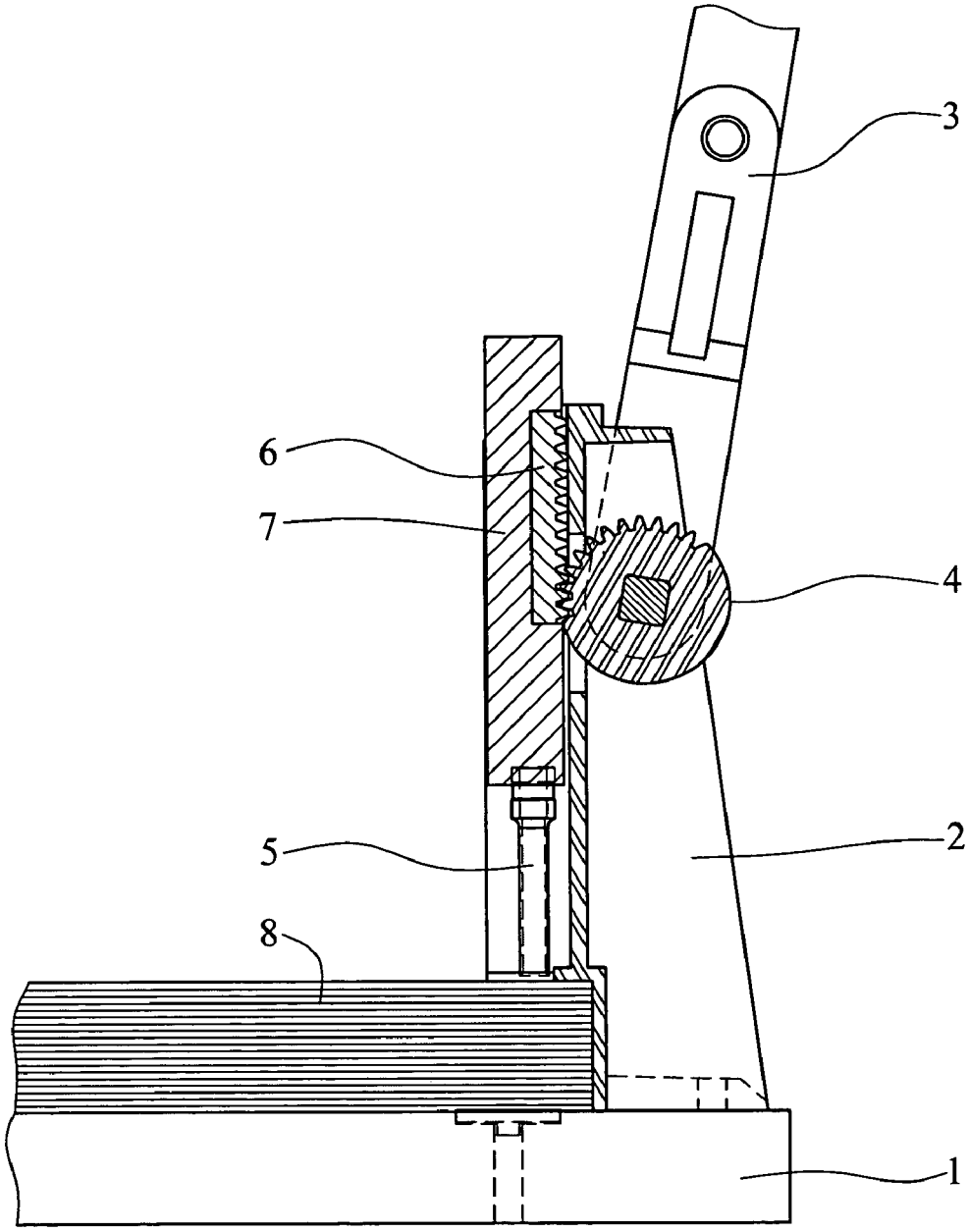
FIG.1 PRIOR ART
FIGS. 1 and 2 show the movement of the handle of a conventional paper punch.
Figure 2:
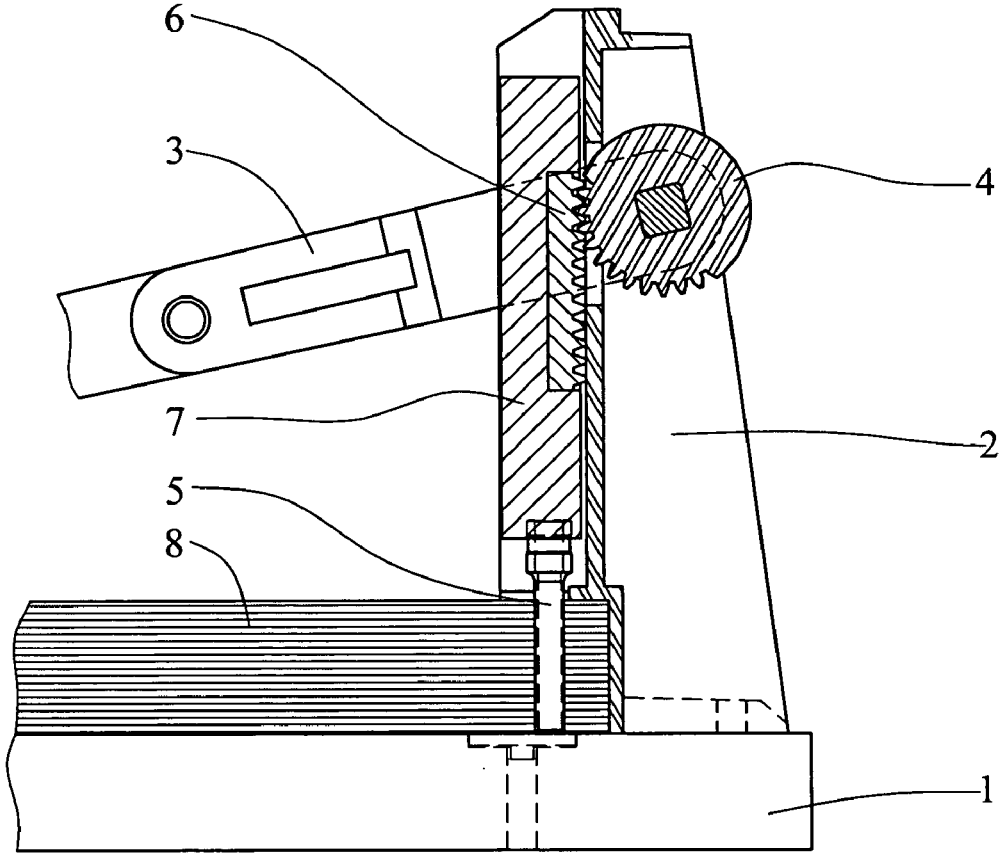
FIG.2 PRIOR ART
Figure 3:
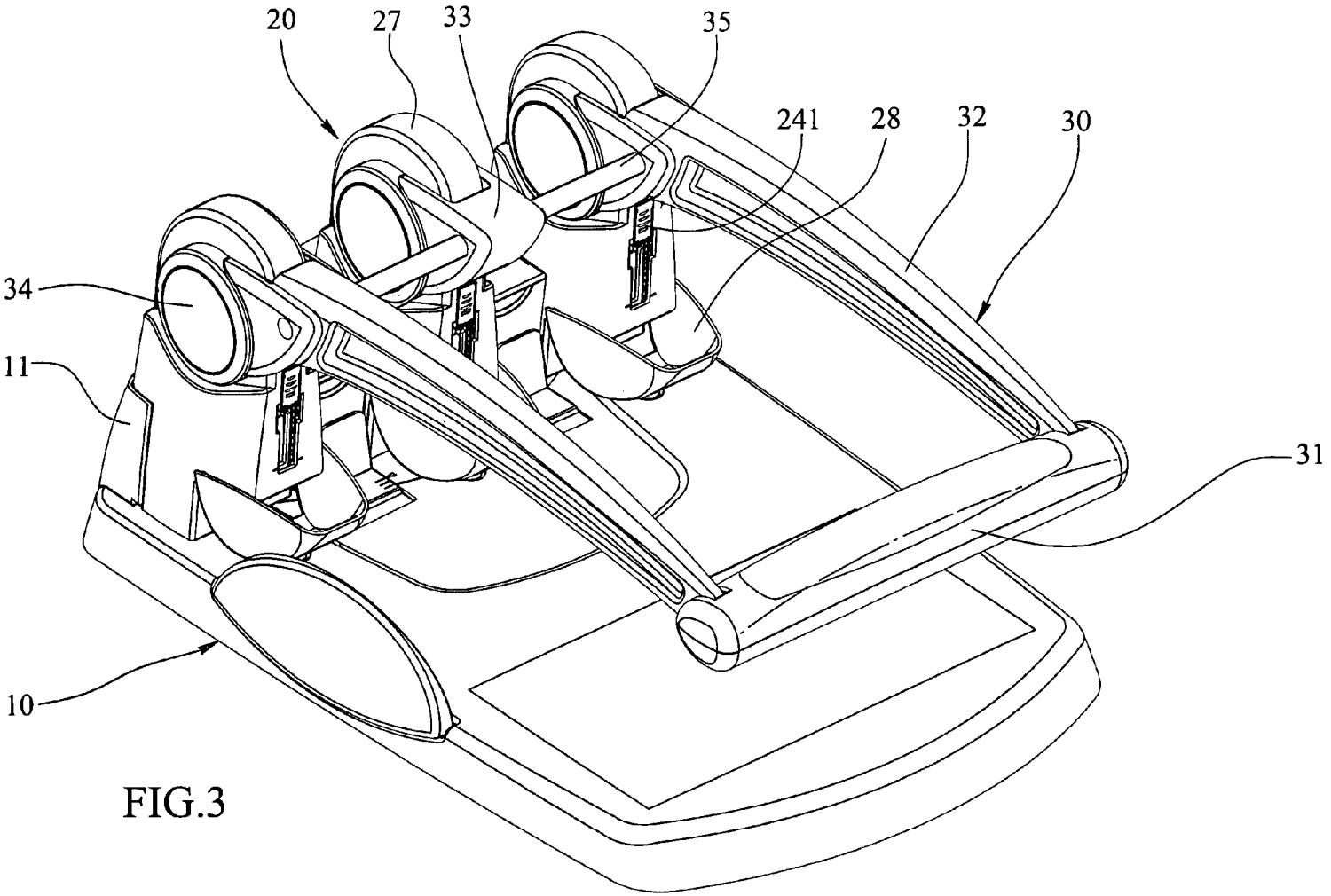
FIG. 3 is a perspective view to show the paper punch of the present invention.
Figure 4:
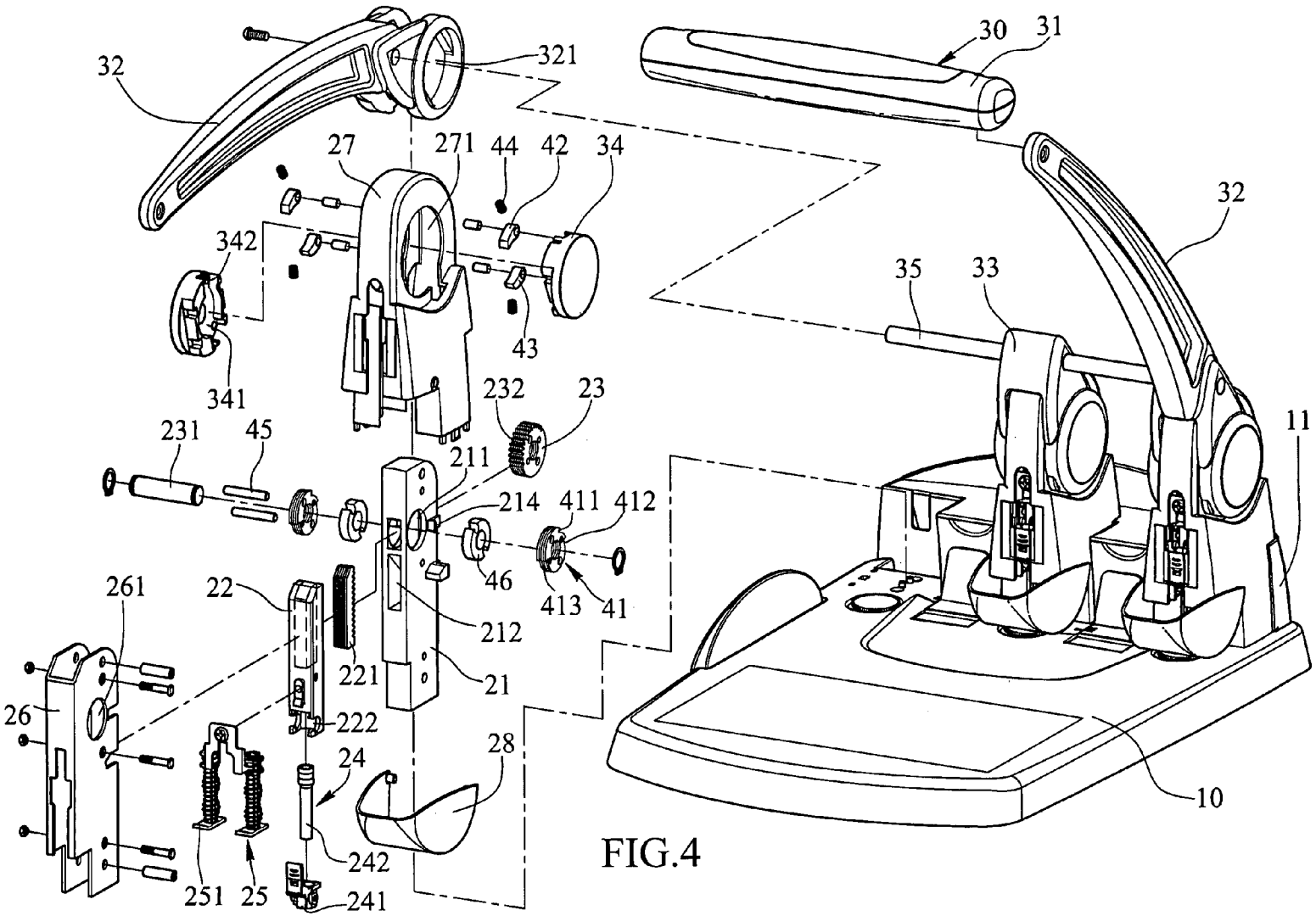
FIG. 4 is an exploded view to show the paper punch of the present invention.
Figure 5A:
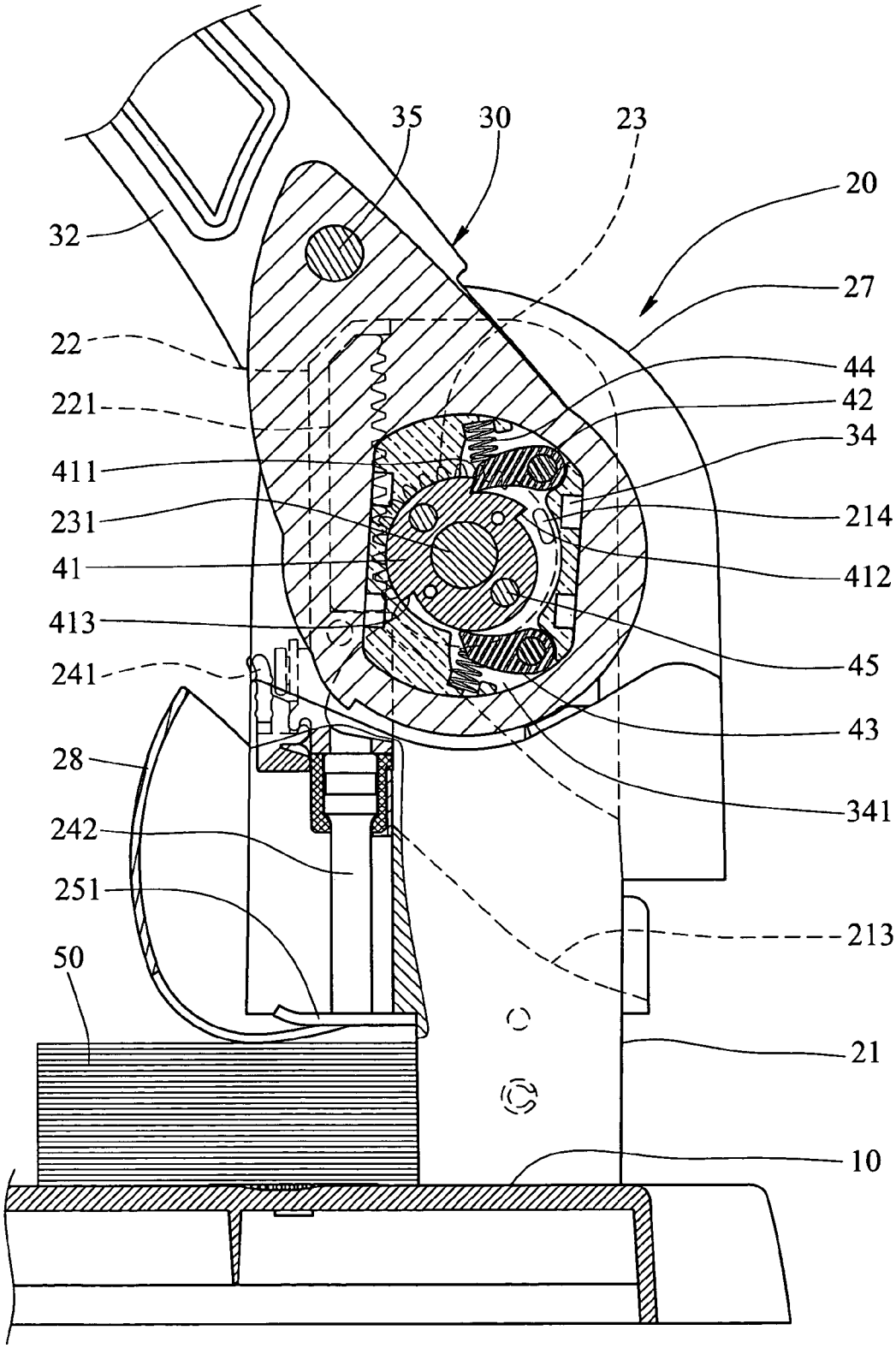
FIG. 5A is a cross sectional view to show that the handle is not yet pivoted downward of the paper punch of the present invention.

Referring to FIGS. 3, 4 and 5A, the paper punch of the present invention comprises a base 10 with three frames 20 connected to top of the base 10. Each frame 20 includes a hollow column 21 fixed on the base 10 and each column 21 includes two through holes 211 defined through two side walls thereof. A slot 212 is defined through a front wall of the column 21 and a debris outlet 213 is defined inclined through the slot 212. A driving gear 23 is located between the two through holes 211 by a pin 231 and includes teeth 232 located on a half circumference of the driving gear 23. A moving member 22 is movably located in a front end of each of the frames 20 and a rack 221 is fixed on the moving member 22. The rack 221 is driven by the driving gear 23 in each of the frames 20 via a slot 212 defined through the front wall of the column 21. Each moving member 22 is connected to a punching head 24. The punch head 24 includes a fixing member 241 and a punch shank 242 which is positioned by the fixing member 241 which is connected to a hooking end 222 on the moving member 22. The moving member 22 further has a pressing member 25 connected thereto and the pressing member 25 includes two pressing plates 251 which are connected with two biasing members and able to be pushed upward. A positioning piece 26 is mounted to a front portion of the column 21 and includes two holes 261 which are located in alignment with the through holes 211 in the column 21, so that the moving member 22 is movable between the column 21 and the positioning piece 26.

A ratchet assembly 40 is received in each of the frames 20 and has two ratchet wheels 41 which are co-rotatably connected to the driving gear 23 by two positioning pins 45, two driving pawls 42 and two return pawls 43. In order to reduce the thickness of the ratchet wheels 41, two separation members 46 are used between the two ratchet wheels 41. Each of the end caps 34 has a recess 341 defined in an inside thereof so that the ratchet wheel 41 is received in the recess 341. Two pawl caves 342 are defined beside the recess 341 so as to receive the driving pawl 42 and the return pawl 43 respectively. Each of the driving pawls 42 and the return pawls 43 is connected with a spring 44 which pushes the driving pawl 42 and the return pawl 43 toward the corresponding ratchet wheel 41. The ratchet wheels 41 is located between the driving pawl 42 and the return pawl 43 in each end cap 34. Each of the ratchet wheels 41 has a first tooth 411, a second tooth 412 and a return tooth 413. The first and second teeth 411, 412 have two respective inclined surfaces with the same inclination and the return tooth 413 has an inclined surface that is opposite to the two inclined surfaces of the first and second teeth 411, 412. A casing 27 is mounted onto the positioning piece 26 and fixed on the base 10. The casing 27 includes two holes 271 which are located in alignment with the holes 261 of the positioning piece 26. A protection cover 28 is connected to the casing 27 so as to protect the user from being accessible to the punching head 24. A collection box 11 is snapped to the casing 27 to collect the punched debris from the paper sheets 50 to be punched.

A handle assembly 30 includes two handles 32 and a bar 31 connected between the two handles 32. The two handles 32 each have a hole 321 defined in a pivotal end thereof and the two end caps 34 are engaged with the two holes 321. The two handles 32 are connected to the first and the third of three frames 20. A rod 35 extends through the two handles 32 and a top member 33 on the second frame 20. Therefore, when pivoting the handle assembly 30, the end caps 34 are co-rotated with the handles 32 and driving pawls 42 and the return pawls 43 are moved with the end caps 34. As shown in FIG. 5A, the driving pawls 42 are engaged with the first teeth 411 of the ratchet wheels 41 when the handles 32 are located at the ready position.

Figure 5B:
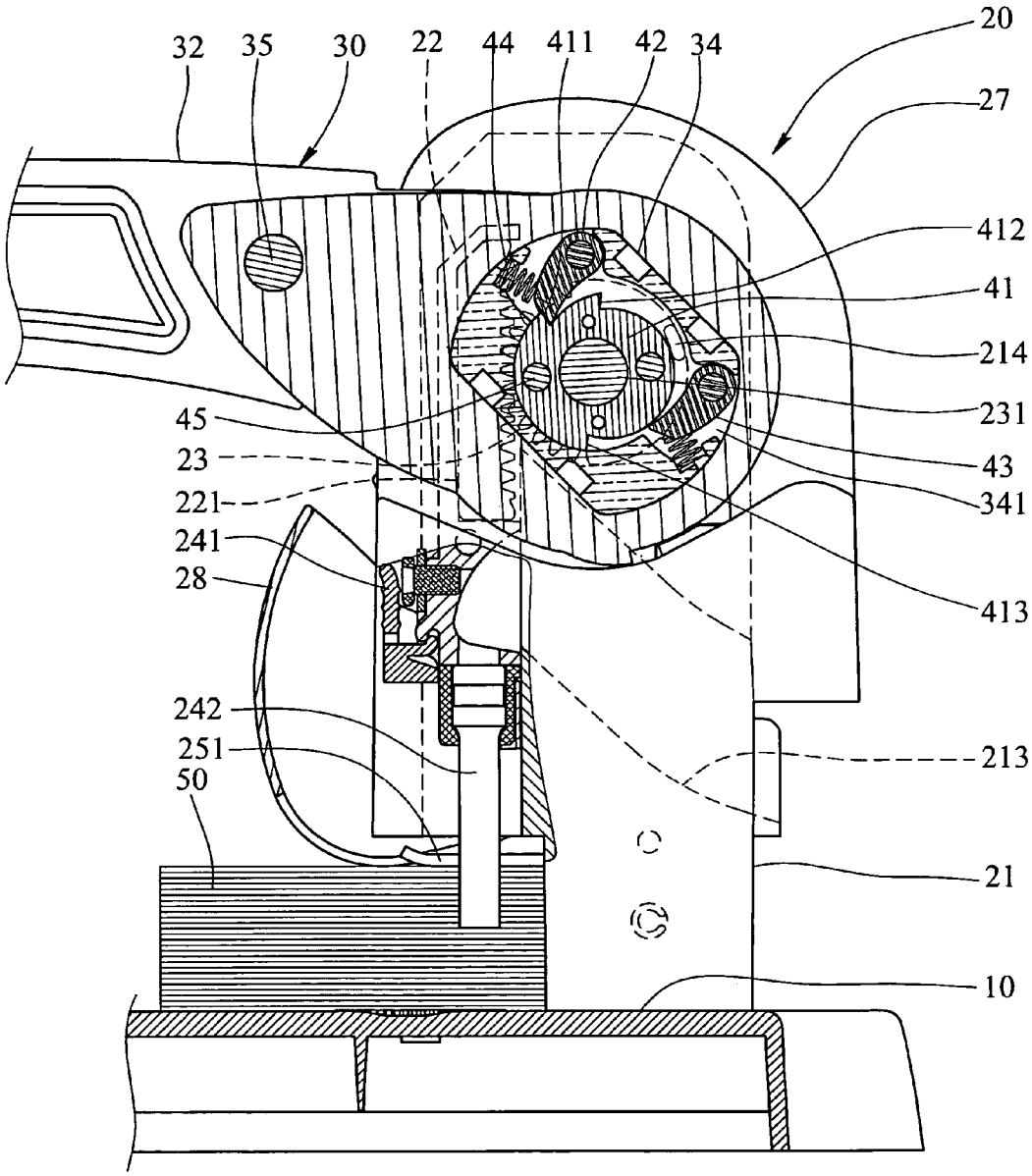
FIG. 5B is a cross sectional view to show that the handle is pivoted downward to lower the punching head of the paper punch of the present invention into a pile of paper sheets to be punched.
Figure 5C:
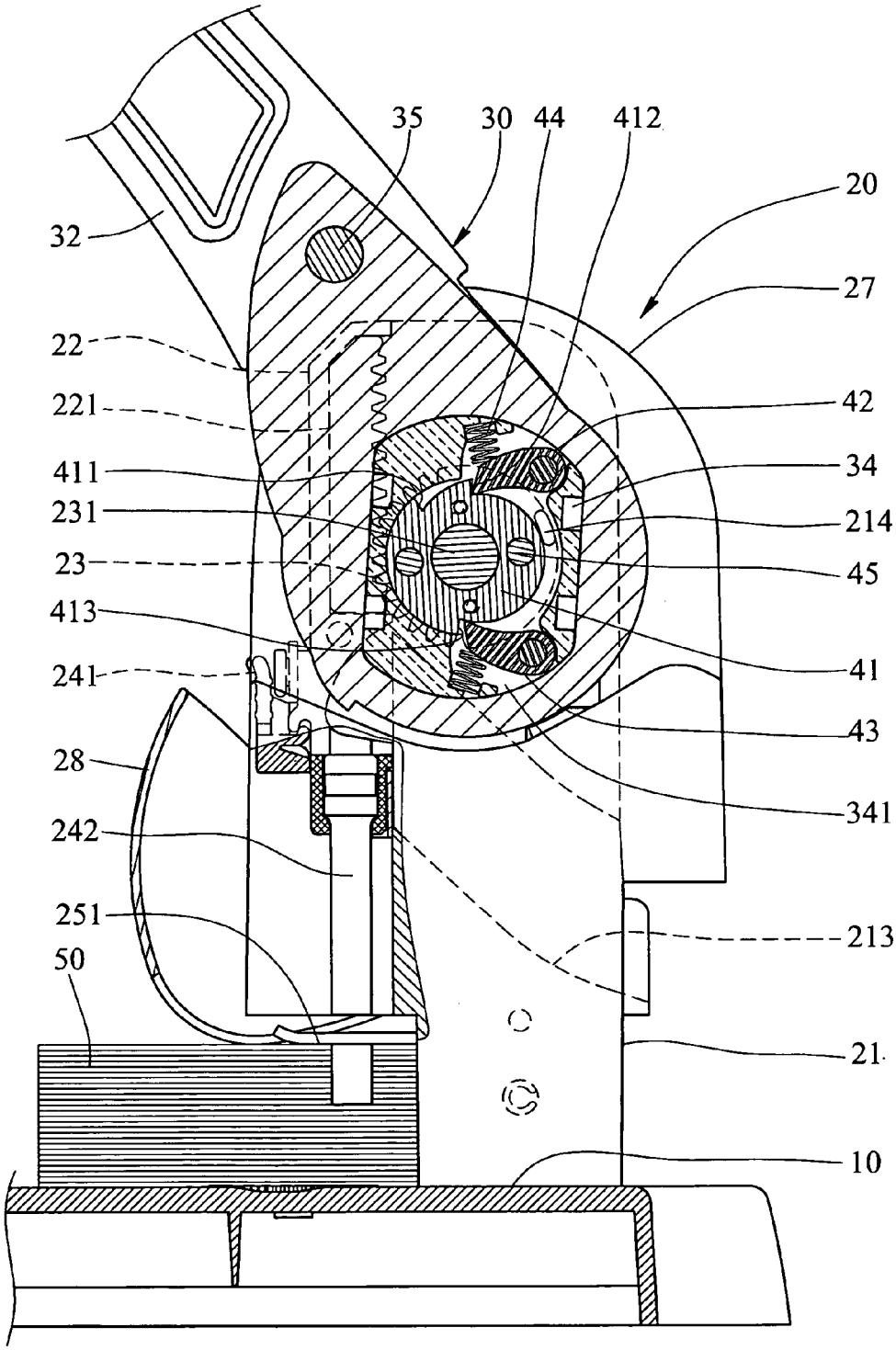
FIG. 5C shows that the handle is pivoted upward while the punching head is kept in the pile of the paper sheets.
Figure 5D:
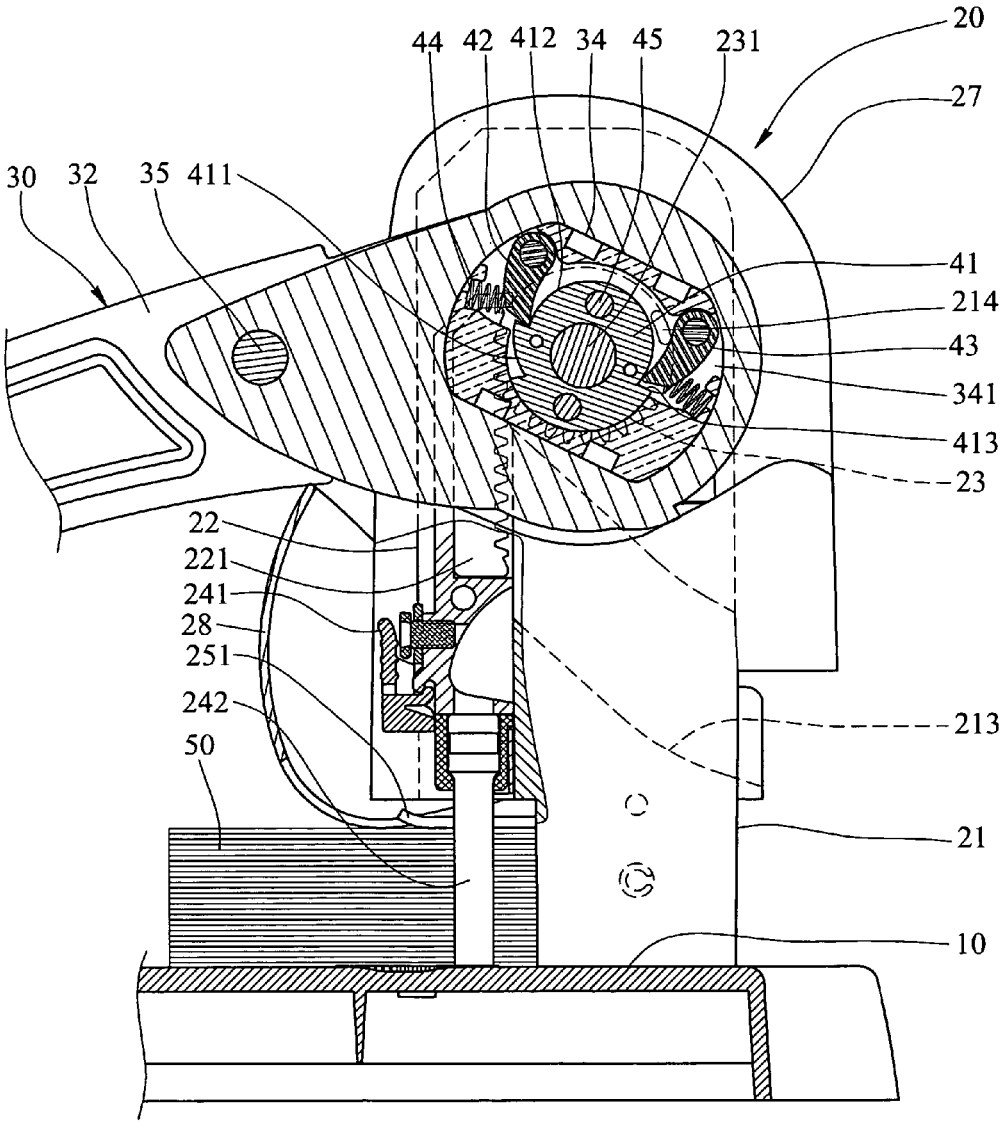
FIG. 5D shows that the handle is again pivoted downward to further lower the punching head to punch the whole pile of the paper sheets.
Figure 5E:
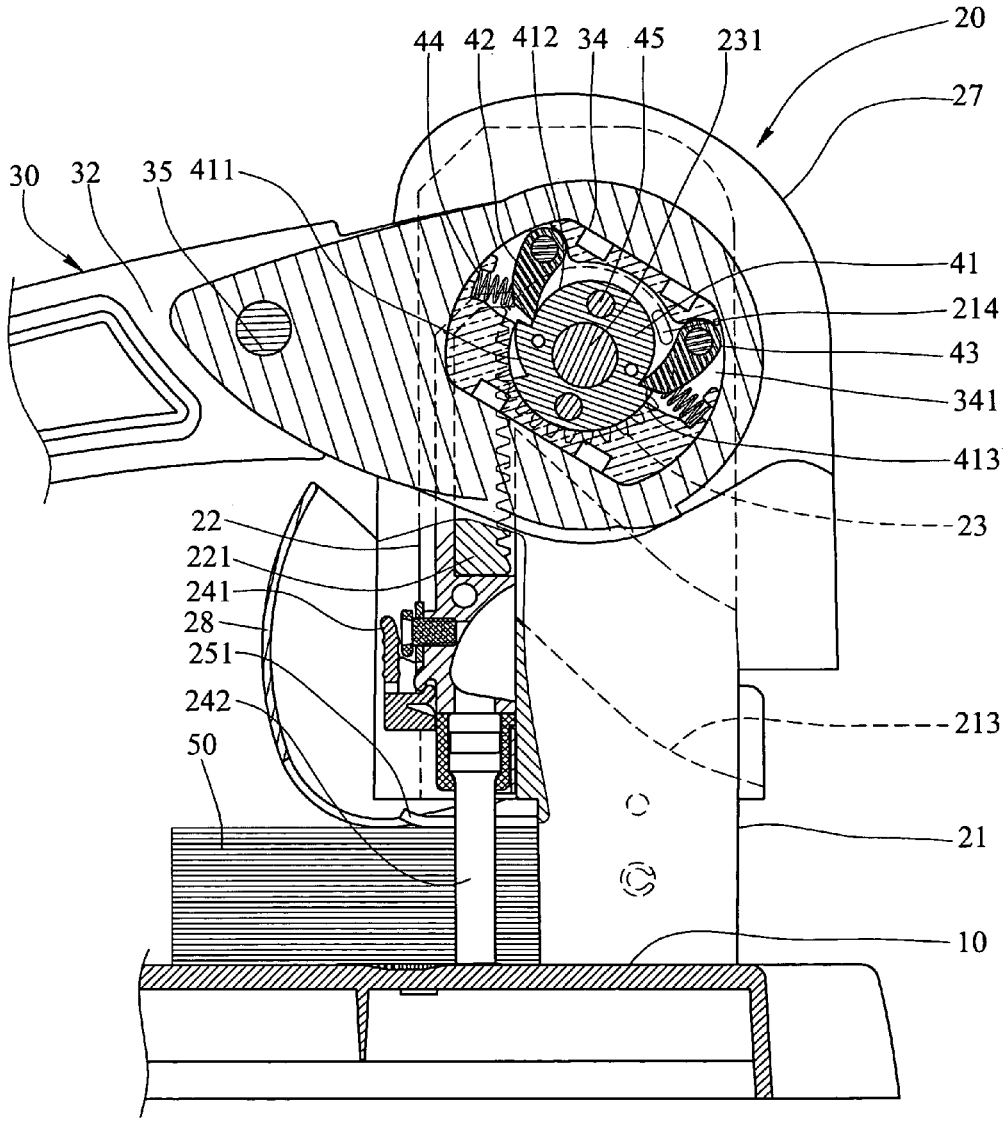
FIG. 5E shows that after the punching action is finished, the handle is to be pivoted upward, the return pawl is engaged with the return tooth.
Figure 5F:
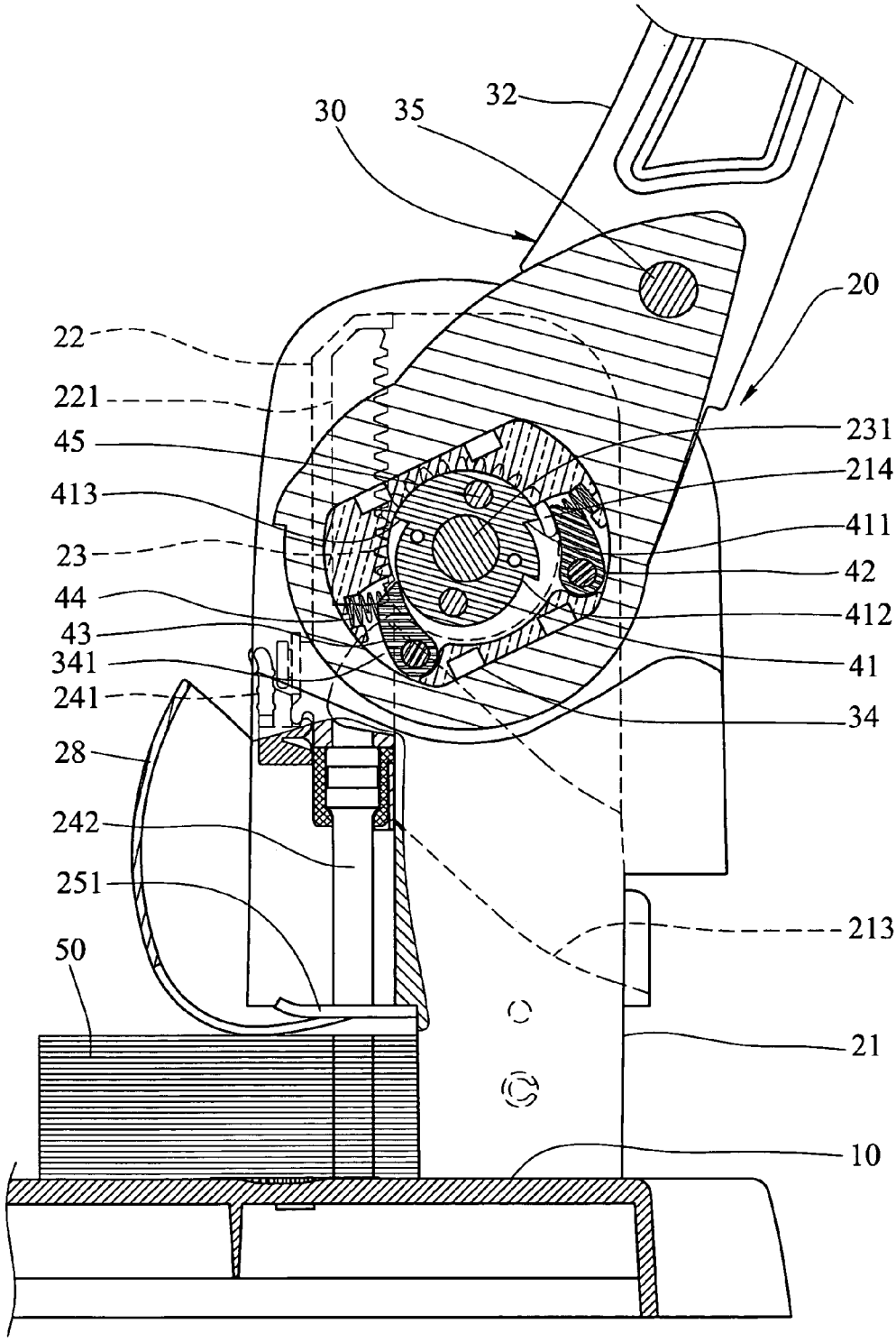
FIG. 5F shows that when pivoting the handle upward, the ratchet wheels are rotated in opposite direction by the return pawl and the driving gears drives the rack to lift the punching head.

As shown in FIG. 5B, when pivoting the handles 32 downward about the rod 35, the driving pawls 42 rotate the ratchet wheels 41 and the ratchet wheels 41 are connected to the driving gears 23, so that the driving gears 23 lower the racks 221 and the punching heads 24 penetrate into the pile of the paper sheets 50. As shown in FIG. 5C, when the handles 32 are pivoted to horizontal position, the user may pivot the handles 32 upward to their original positions as shown in FIG. 5A. The driving pawl 42 of each ratchet assembly 40 is then moved and engaged with the second tooth 412. The user then pivots the handles 32 downward again, the punching heads 24 are then further lowered to complete the punching action as shown in FIG. 5D. It is noted that each column 21 has two protrusions 214 on two sides thereof. As shown in FIG. 5F, the driving pawls 42 are pushed away from the ratchet wheels 41 by the protrusions 214 and the return pawls 43 are engaged with the return teeth 413 on the ratchet wheels 41. Accordingly, when the user pivoting the handles 32 upward, the return pawls 43 drives the return wheels 41 and the driving gears 23, and lift the punching heads 24 from the pile of the paper sheets 50. The driving pawls 42 are re-engaged with the first teeth 411.

By the special arrangement, the punching action can be done by repeatedly operating the handles 32 and each pivotal action of the handles 32 travels an angular distance less than 90 degrees. Each time the handles 32 are pivoted downward, only half of the paper sheets are punched so that the resistance for each pivotal action is less than that for the conventional paper punch.

While we have shown and described the embodiment in accordance with the present invention, it should be clear to those skilled in the art that further embodiments may be made without departing from the scope of the present invention.

What is claimed is:

1. A paper punch comprising:

a base (10) with a plurality of frames (20) extending from a top of the base (10), each frame (20) including a hollow column (21) which is fixed on the base (10) and each column (21) having a driving gear (23) received therein, a moving member (22) movably located in front of each of the frames (20) and driven by the driving gear (23) in each of the frames (20), each moving member (22) connected to a punching head (24);

a handle assembly (30) co-rotatably connected to the driving gears (23) in the frames (20) and including a plurality of handles (32), each handle (32) having two end caps (34) connected on two sides thereof, and a ratchet assembly (40) received in each of the frames (20) and having two ratchet wheels (41) connected to the driving gear (23), two driving pawls (42) and two return pawls (43), each of the end caps (34) having one of the two driving pawls (42) and one of the return pawls (43) received therein, each of the ratchet wheels (41) located between the driving pawl (42) and the return pawl (43) in each end cap (34), each of the ratchet wheels (41) having a first tooth (411), a second tooth (412) and a return tooth (413), the first and second teeth (411, 412) having two respective inclined surfaces with the same inclination and the return tooth (413) having an inclined surface that is opposite to the two inclined surfaces of the first and second teeth (411, 412), the driving pawls (42) engaged with the first teeth (411) and the second teeth (412) in sequence to rotate the ratchet wheels (41) and the driving gear (23) in two times of downward pivotal movement of the handles (32), the return teeth (413) engaged with the return teeth (413) of the ratchet wheels (41) and rotating the ratchet wheels (41) and the driving gear (23) by pivoting the handles (32) upward after the two times of downward pivotal movement of the handles (32).

2. The paper punch as claimed in claim 1, wherein each column (21) has two protrusions (214) on two sides thereof and the driving pawls (42) are pushed away from the ratchet wheels (41) and re-engaged with the first teeth (411) when moving over the protrusions (214).

3. The paper punch as claimed in claim 1, wherein each of the driving pawls (42) and the return pawls (43) is connected with a spring (44) which pushes the driving pawl (42) and the return pawl (43) toward the corresponding ratchet wheel (41).

4. The paper punch as claimed in claim 1, wherein the punch head (24) includes a fixing member (241) and a punch shank (242) which is positioned by the fixing member (241) which is connected to a hooking end (222) on the moving member (22).

5. The paper punch as claimed in claim 1, wherein the column (21) of each of the frames (20) includes through holes (211) defined through two side walls thereof and a slot (212) is defined through a front wall of the column (21), the driving gear (23) located between the two through holes (211) by a pin (231), the moving member (22) located beside the front wall of the column (21) and has a rack (221) which is engaged with the driving gear (23) via the slot (212), a positioning piece (26) mounted to a front portion of the column (21) and including two holes (261) which are located in alignment with the through holes (211) in the column (21), so that the moving member (22) is movable between the column (21) and the positioning piece (26).

6. The paper punch as claimed in claim 5, wherein the driving gear (23) includes teeth (232) located on a half circumference of the driving gear (23) and engaged with the rack (221).

7. The paper punch as claimed in claim 5, wherein the moving member (22) has a pressing member (25) connected thereto and the pressing member (25) includes two pressing plates (251) which are connected with two biasing members and able to be pushed upward.

8. The paper punch as claimed in claim 5, wherein a casing (27) is mounted onto the positioning piece (26) and fixed on the base (10), the casing (27) includes two holes (271) which are located in alignment with the holes (261) of the positioning piece (26).

* * * * *